US006095378A

United States Patent [19]

Potts et al.

[11] Patent Number: 6,095,378

[45] Date of Patent: Aug. 1, 2000

[54] AEROSOL CONTAINERS

[75] Inventors: Richard W. Potts, North Caldwell; Frank A. Maloney, Verona, both of N.J.

[73] Assignee: Peerless Tube Company, Bloomfield, N.J.

[21] Appl. No.: 09/251,587

[22] Filed: Feb. 17, 1999

Related U.S. Application Data

[63] Continuation-in-part of application No. 29/093,788, Sep. 18, 1998, and a continuation-in-part of application No. 29/073,489, Jul. 14, 1997, which is a continuation-in-part of application No. 29/046,731, Oct. 30, 1995, abandoned

[60] Provisional application No. 60/101,017, Sep. 18, 1998.

[51] Int. Cl.[7] ..... B65D 83/00

[52] U.S. Cl. ..... 222/402.1; 222/402.13; 239/337; D9/500

[58] Field of Search ..... 222/394, 402.1–402.13; 239/333, 337; D9/300, 500–505

[56] References Cited

U.S. PATENT DOCUMENTS

| | | | |
|---|---|---|---|
| D. 188,142 | 6/1960 | Sinel | D9/300 |
| D. 226,370 | 2/1973 | Cromb | D9/500 |
| 2,856,102 | 10/1958 | Remington et al. | 222/402.1 |
| 3,048,307 | 8/1962 | Michel | 239/337 |
| 3,161,460 | 12/1964 | Huber | 239/337 |
| 3,272,390 | 9/1966 | Horwitt | 222/394 |
| 3,731,647 | 5/1973 | Mimbiole, Jr. et al. | 118/667 |
| 3,912,131 | 10/1975 | Friedman et al. | 222/402.1 |
| 4,901,891 | 2/1990 | Goncalves | 222/402.1 |
| 5,915,599 | 6/1999 | Takahashi | 222/402.13 |

*Primary Examiner*—Andres Kashnikow
*Assistant Examiner*—Dinh Q. Nguyen
*Attorney, Agent, or Firm*—Riker, Danzig, Scherer, Hyland & Perretti LLP

[57] ABSTRACT

An aerosol container has a straight cylindrical lower portion and a rounded tapered upper portion ending in a sharply tapered narrow shoulder section and a restricted neck with a rounded beaded top opening which has a smaller outer diameter than the shoulder. A valve assembly is received in the open end with the valve base seated in the space between the shoulder and bead diameters without extending beyond the shoulder. A valve cover fits over the base within the same perimeter to provide a generally streamlined configuration.

8 Claims, 4 Drawing Sheets

AEROSOL CONTAINERS

CROSS-REFERENCE TO RELATED APPLICATIONS

BACKGROUND OF THE INVENTION

This application claims the benefit of U.S. Provisional Application No. 60/101,017, filed Sep. 18, 1998, and is also a continuation-in-part of U.S. Application No. 29/093,788 filed Sep. 18, 1998, and U.S. Application No. 29/073,489 filed Jul. 14, 1997, which are continuations-in-part of U.S. Application No. 29/046,731, filed Oct. 30, 1995, now abandoned.

1. Field of the Invention

The present invention relates to aerosol containers and particularly to aerosol containers having a rounded tapered upper portion ending in a sharply tapered narrower shoulder section and restricted neck with a rounded beaded top which has a smaller diameter or width than the shoulder section.

2. Description of the Prior Art

Several patents relating to various container structures were cited in the earlier above applications. None of these show the present unique rounded tapered upper portion having a narrower sharply tapered upper shoulder and top bead which has a narrower width than the shoulder below. This permits insertion of a valve assembly into the top opening with a base that rests on the shoulder. The spacing between the bead and shoulder allows the base to seat with no extension beyond the shoulder or outer perimeter of the tapered container. A cover fits over the valve and base and also does not extend outwardly.

U.S. Design Pat. No. 226,370 to Cromb shows a bottle having a top bead portion extending beyond the straight tapered area below and has no upper shoulder.

U.S. Pat. No. 3,995,572 to Saunders shows a container having a narrow multi-staged upper necked portion with straight bottom, top and upper opening areas.

U.S. Design Pat. No. 66,103 to Koch shows a bottle with a straight upper tapered section and a prominent bead at the top extending beyond the lower tapered area with no shoulder.

U.S. Design Pat. Nos. 219,125 and 219,127 to Gortz show tapered containers with indented neck portions and dispenser caps that extend beyond the necked portions. There is no top bead with a dimension smaller than a shoulder.

U.S. Design Pat. No. 228,625 to Pearce again shows a bottle having a top lipped portion extending outwardly of a straight tapered portion below and there is no shoulder.

U.S. Pat. No. 2,521,961 to Bacheller shows a bottle with a tapered upper portion having an outwardly extending rim and two narrower necked sections at the top. There is no narrow shoulder ending in a smaller top bead. A dispenser and collar fit into and over the bottle.

U.S. Pat. No. 4,220,285 to Gualdi shows a container having a tapered upper area and a straight necked narrower top portion into which a sprayer unit is inserted. There is no top bead with a smaller diameter than a lower shoulder portion.

The publication in Aerosol Age of March 1978, page 33, shows several aerosol containers having upper tapered ends with no narrower shoulders and no top beads of smaller dimensions than the shoulders.

U.S. Pat. No. 3,161,460 to Huber shows a container having a tapered upper portion and a spraying unit fitting into an open end. There is no narrow shoulder at the upper end of the tapered portion and no bead of a smaller width than the shoulder.

U.S. Pat. No. 3,184,118 to Webster shows an aerosol spray container having an upper rounded tapered portion with a rounded upper lip receiving a sealing cap and valve. There is no narrow shoulder portion with a top bead of a smaller dimension than the shoulder.

U.S. Pat. No. 3,182,864 to Ellis et al shows a straight sided tubular aerosol can having a first upper linear abruptly tapered portion and a second rounded tapered portion extending abruptly from the linear portion. A beaded upper edge receives a valve cup and valve assembly. There is no rounded tapered upper portion having a sharply tapered narrower shoulder with a restricted neck ending in a top bead of a smaller dimension than the shoulder.

U.S. Pat. No. 3,272,402 to Frangos shows a valved aerosol container having a straight cylindrical lower end with a sharp flat shoulder and rounded tapered upper end having a straight neck and curved top lip. There is no sharply tapered narrow shoulder and no top bead.

U.S. Pat. No. 3,283,962 to Whitmore show a valved aerosol container having a straight tapered upper section with no narrow tapered shoulder and no narrower top bead.

While many variations of aerosol containers are known, none have the unique upper rounded tapered portion, narrow sharply tapered shoulder portion with a restricted neck and a top bead of a smaller dimension than the shoulder. This novel structure permits insertion of a valve into the beaded opening and provides a space between the shoulder and bead which receives the base of the valve that seats on the shoulder without protruding beyond the smooth outer perimeter of the upper tapered container. A valve cover fits over the valve within the same dimensions.

OBJECTS AND SUMMARY OF THE INVENTION

It is therefore the primary object of the present invention to provide an aerosol container having a unique streamlined configuration.

It is another object of the invention to provide a cylindrical container having a tapered upper portion and a narrow shoulder ending in a top bead which has a smaller dimension than the shoulder.

It is a further object of the invention to provide a cylindrical container with a tapered upper portion having a narrow shoulder portion and top bead spaced inwardly from the shoulder to receive a valve within the top bead portion and a valve base seated in the space between the shoulder and top bead.

A still further object is to provide an aerosol container with a rounded tapered upper portion, a narrow shoulder portion and a top bead which is of a smaller dimension than the shoulder to receive a valve base which rests on the shoulder and having an outer dimension which does not extend beyond the shoulder.

Yet another object of the invention is to provide an aerosol container having a rounded tapered upper portion, a sharply tapered narrow shoulder portion with a restricted neck and a top bead of a smaller dimension than the shoulder.

An additional object is to provide an aerosol container having a rounded tapered upper portion, a sharply tapered narrow shoulder with a restricted neck and top bead of a smaller dimension than the shoulder, and a valve having a base resting on the shoulder with a cover over the valve, the valve base and cover dimensions not extending beyond the shoulder.

These objects are achieved with a uniquely configured aerosol container having an upper rounded tapered portion ending in a sharply tapered narrow shoulder portion with a restricted neck and a top beaded opening having a bead which extends over the neck and having a smaller dimension than the shoulder. A valve is receivable within the top beaded opening and a valve base is seated over the top bead on the shoulder without protruding beyond the shoulder. A valve cover seats on the base within the same dimension. This provides a novel streamlined shape to the container.

Other objects and advantages will become apparent from the following description taken in conjunction with the accompanying drawings.

DESCRIPTION OF THE PREFERRED EMBODIMENTS

Figure 1:
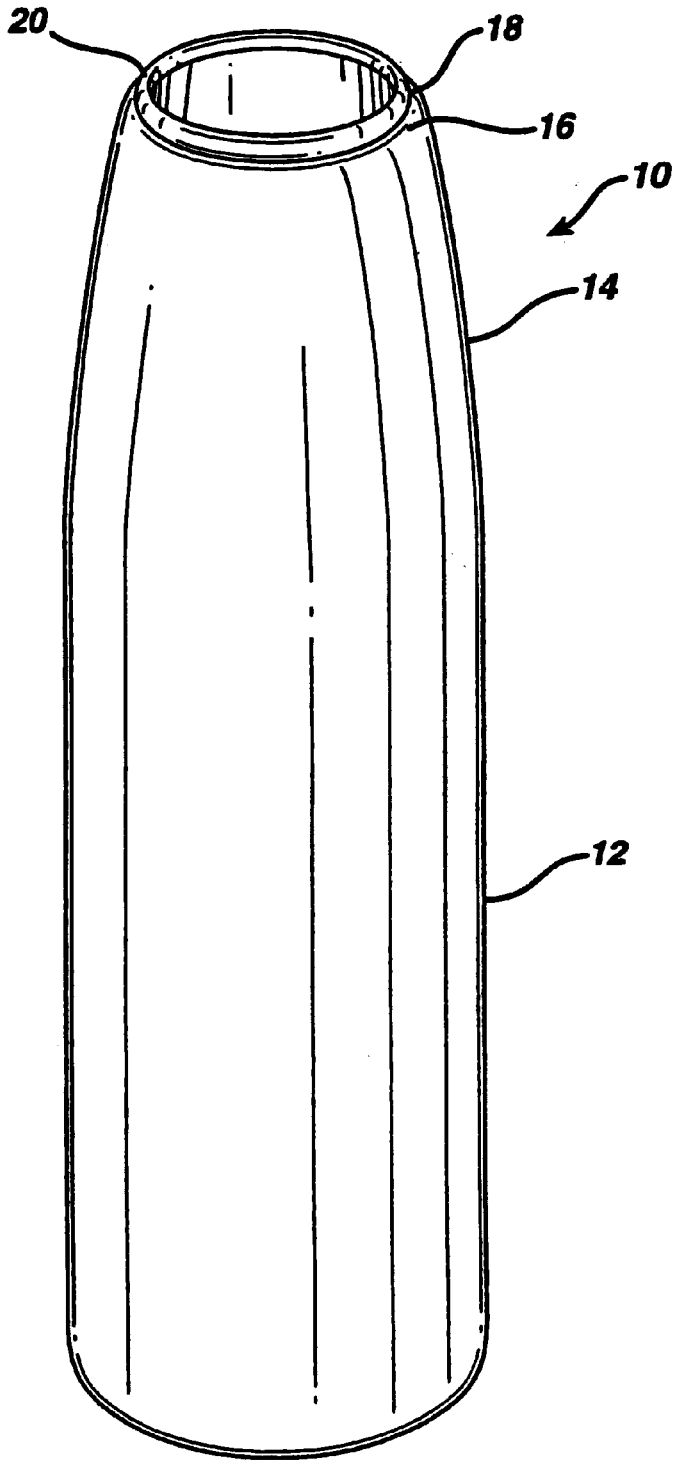
FIG. 1 is a side perspective view of the aerosol container showing the upper open end.
Figure 2:
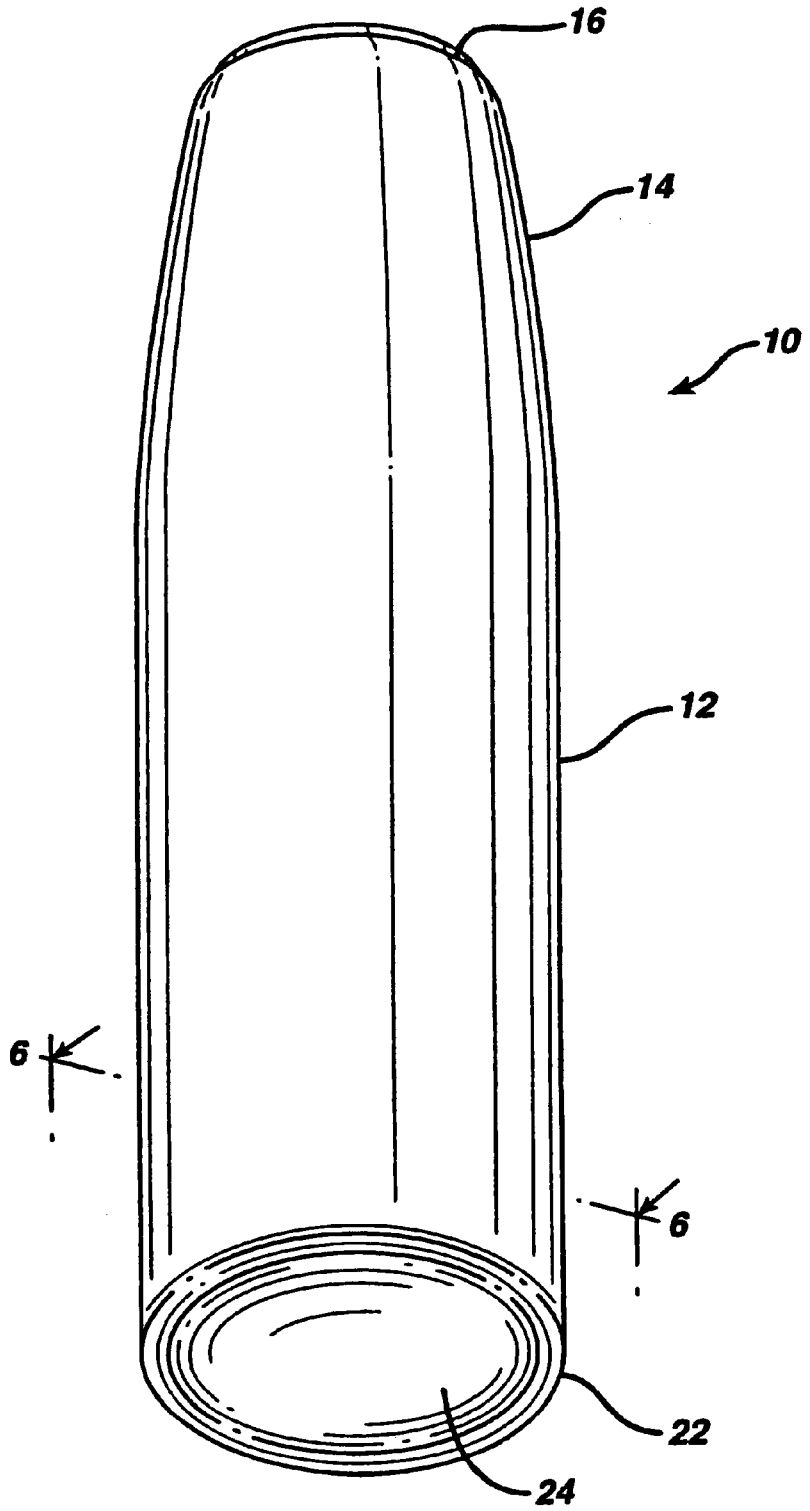
FIG. 2 is a side perspective view of the aerosol container showing the bottom closed end.
Figure 3:
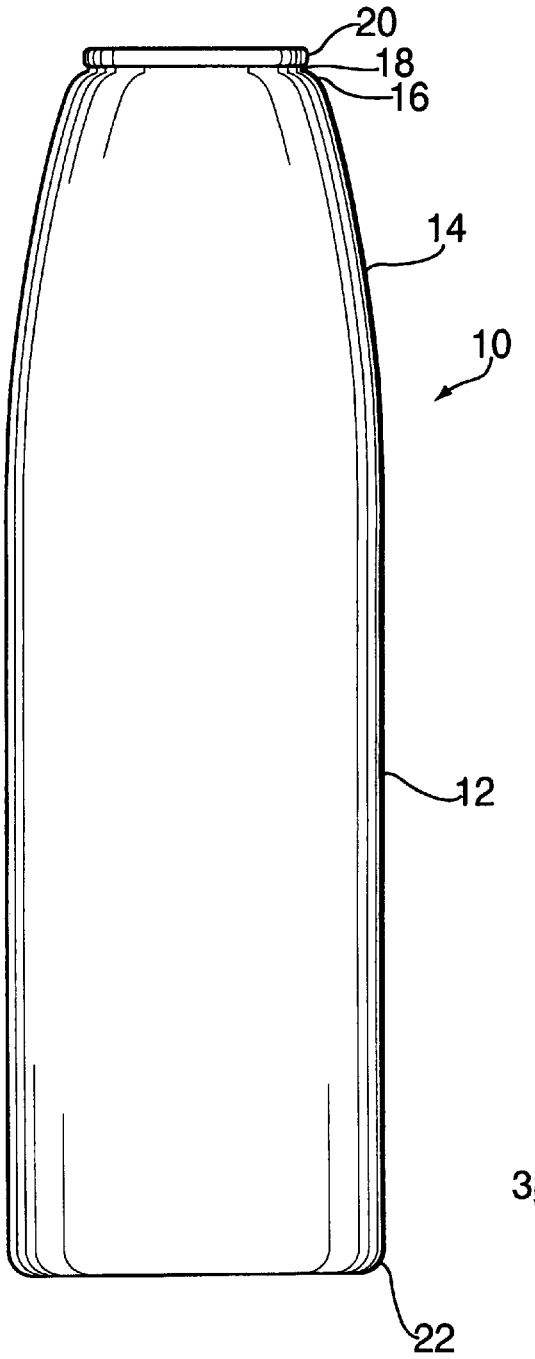
FIG. 3 is a side view of the container showing the tapered upper end, sharply tapered shoulder, restricted neck and top narrow bead.
Figure 4:
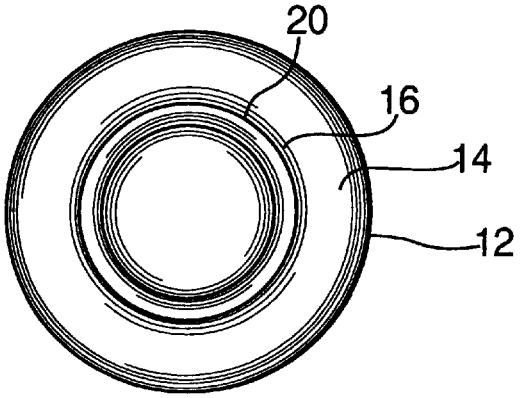
FIG. 4 is a top view of the open end showing the top bead and shoulder.
Figure 5:
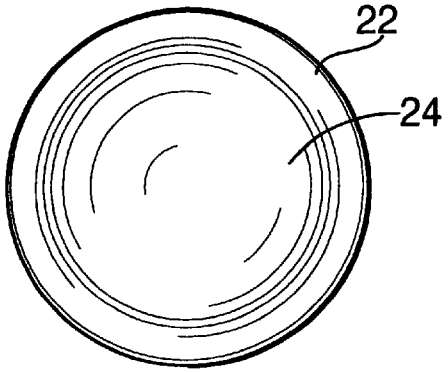
FIG. 5 is a bottom view showing the rounded closed bottom end.
Figure 6:
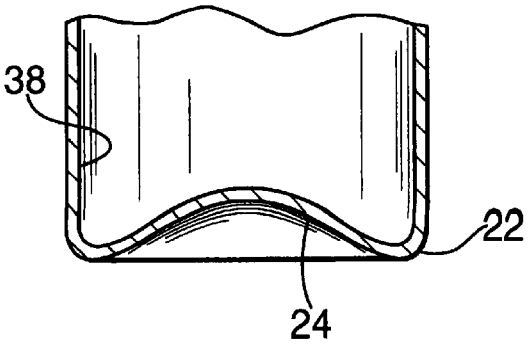
FIG. 6 shows a cross section taken along lines 6—6 of FIG. 2 of the lower end of the container and closed bottom.

As shown in FIG. 1, the aerosol container 10 includes a straight cylindrical lower portion 12 of approximately two-thirds of the height and a rounded gradually tapered narrower upper portion 14. The taper may be conical as well as spherical. The upper portion ends in a sharp inwardly tapered shoulder 16, shown more clearly in FIG. 3, having a restricted neck 18, and a open ended top bead 20 which has a smaller diameter or outer dimension than the shoulder 16. FIG. 4 shows these container elements in a top or plan view. The bottom portion of the container is shown in FIGS. 2, 5 and 6. The lower end 22 is rounded and has an inwardly curved concave closed bottom 24.

Figure 7:
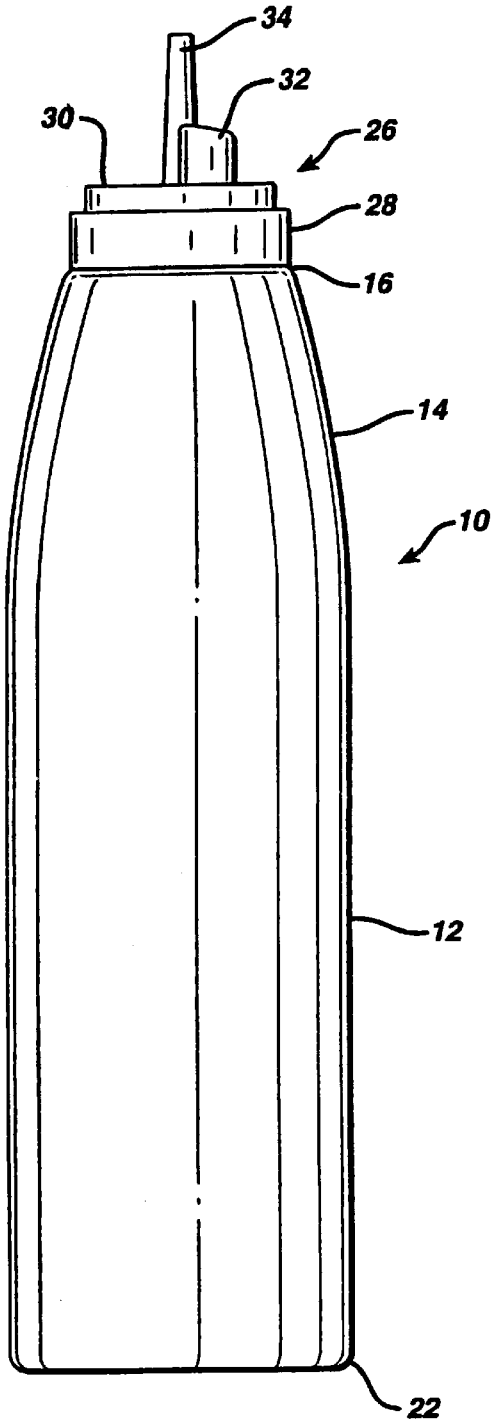
FIG. 7 is a side view of the container showing a valve unit inserted into and sealed to the open top beaded end with the valve base seated on the shoulder.
Figure 8:
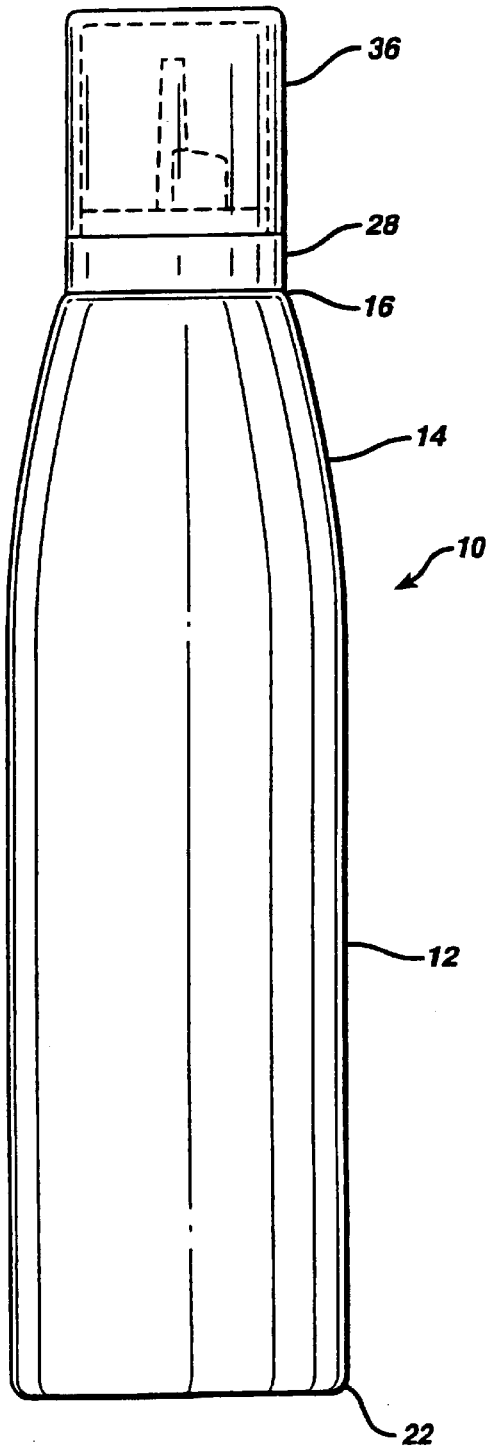
FIG. 8 is a side view of the container showing a top cover positioned over the valve and seated on the valve base within the outer dimension of the shoulder to provide a streamlined outer configuration.

As shown in FIGS. 7 and 8, a dispenser valve assembly 26 is inserted into and sealed within the open beaded end of aerosol container 10. The base 28 of the valve assembly has a wall thickness which permits it to be sealed over bead 20 on shoulder 16 in the space between the outer diameters of the bead and shoulder so that the outer dimension of the valve base does not extend beyond the perimeter of the rounded tapered upper portion 14 at the upper end where it transitions into the sharply tapered shoulder 16. A stepped platform 30 above the base includes a valve control element 32 and a nozzle 34. When control element 32 is operated by pressing down on the upper surface, the internal valve, not shown, is opened to dispense the pressurized contents of the aerosol container through nozzle 34 in the form of a spray. The valve closes when control 32 is released.

As shown in FIG. 8, a translucent cover 36 fits over valve assembly 26, with the lower edge of the cover engaging the stepped platform 30 to seat on base 28. The inner valve elements and cover surfaces are shown in dashed lines. The thickness of the cover matches the dimensions between the outer diameters of platform 30 and base 28 to provide a smooth transition from base to cover without extending beyond the perimeter of the tapered shoulder and upper portion of container 10. The overall configuration thus provides a desired streamlined shape.

The container is preferably made of a thin light aluminum material which can be formed into a tubular structure in a conventional manner by impact extrusion, progressive dyes for stretching, necking and rolling to form a bead. The valve of a suitable plastic material is placed in the beaded opening with the base over the bead to seat on the shoulder and the assembly crimped and sealed onto the bead. The processing includes application of various internal protective coatings 38, shown in FIG. 6, prior to sealing and external decorative designs, printing and further protective coatings.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An aerosol container comprising:

a lower relatively straight cylindrical portion having a closed lower end, an upper gradually tapered narrower portion, a sharply tapered narrower shoulder portion at the end of said gradually tapered portion, a restricted neck portion at the end of said shoulder portion, a beaded upper open end having a diameter which is smaller than that of said shoulder portion, a dispenser valve assembly received in and enclosing said open end, a valve base seated over said beaded end on said shoulder portion, said valve base having an outer diameter smaller than that of said shoulder portion, wherein the difference between the outer diameter of said shoulder portion and the outer diameter of said beaded end provides a space, said valve base having a wall thickness fitting within said space on said shoulder, a stepped platform on said base, said base platform having a nozzle and control element thereon, and a valve assembly cover engageable with said stepped platform to seat on said base, the outer diameter of said valve assembly cover having substantially the same outer diameter as said base, said valve assembly cover and base outer diameters being smaller than that of said shoulder portion.

2. An aerosol container comprising:

a lower relatively straight cylindrical portion having a closed lower end, an upper gradually tapered narrower portion, a sharply tapered narrower shoulder portion at the end of said gradually tapered portion, a restricted neck portion at the end of said shoulder portion.

a beaded upper open end having a diameter which is smaller than that of said shoulder portion, a dispenser valve assembly received in and enclosing said open end, a valve base seated over said beaded end on said shoulder portion, said valve base having an outer diameter smaller than that of said shoulder portion, wherein the difference between the outer diameter of'said shoulder portion and the outer diameter of said beaded end provides a space, said valve base having a wall thickness fitting within said space on said shoulder.

3. The device of claim 2 wherein said lower end is rounded and concave.

4. The device of claim 2 wherein said upper gradually tapered portion is rounded.

5. The device of claim 2 wherein the lower straight portion extends for approximately ⅔ of the container length and the tapered portion extends for about ⅓ of the length.

6. The device of claim 2 wherein said container is of a thin lightweight aluminum.

7. The device of claim 2 including an internal protective coating on the interior surfaces of said container.

8. The device of claim 2 wherein said valve assembly is of a plastic material.

* * * * *